US011633325B2

(12) United States Patent
Baetica et al.

(10) Patent No.: US 11,633,325 B2
(45) Date of Patent: Apr. 25, 2023

(54) SEXUAL STIMULATION DEVICE

(71) Applicant: WOW TECH CANADA LTD., Ottawa (CA)

(72) Inventors: Florin Baetica, Brookville (CA); Grant Mark Bechthold, Ottawa (CA); Bruce Donald Murison, North Gower (CA)

(73) Assignee: Wow Tech Canada Ltd., Ottawa (CA)

( * ) Notice: Subject to any disclaimer, the term of this patent is extended or adjusted under 35 U.S.C. 154(b) by 0 days.

(21) Appl. No.: 17/704,973

(22) Filed: Mar. 25, 2022

(65) Prior Publication Data

US 2022/0211571 A1 Jul. 7, 2022

Related U.S. Application Data

(62) Division of application No. 14/129,761, filed as application No. PCT/CA2012/050442 on Jun. 29, 2012, now abandoned.

(60) Provisional application No. 61/503,679, filed on Jul. 1, 2011.

(51) Int. Cl.

| | |
|---|---|
| ***A61H 19/00*** | (2006.01) |
| ***A61H 23/02*** | (2006.01) |
| ***A61H 23/00*** | (2006.01) |

(52) U.S. Cl.

CPC ..... *A61H 19/34* (2013.01); *A61H 19/40* (2013.01); *A61H 19/50* (2013.01); *A61H 23/00* (2013.01); *A61H 23/0263* (2013.01); *A61H 2201/1692* (2013.01); *A61H 2201/5002* (2013.01); *A61H 2201/5012* (2013.01); *A61H 2201/5015* (2013.01); *A61H 2201/5038* (2013.01)

(58) Field of Classification Search

CPC ..... A61H 19/34; A61H 19/40; A61H 19/50; A61H 23/00; A61H 23/0263; A61H 2201/1692; A61H 2201/5002; A61H 2201/5012; A61H 2201/5015; A61H 2201/5038

See application file for complete search history.

(56) References Cited

U.S. PATENT DOCUMENTS

| | | | | |
|---|---|---|---|---|
| 3,996,930 A * | 12/1976 | Sekulich | ..... | A61H 19/34 601/137 |
| 5,928,170 A * | 7/1999 | Garrigan | ..... | A61H 19/44 601/47 |
| 2010/0305483 A1* | 12/2010 | Werdt | ..... | A61H 23/00 601/46 |

* cited by examiner

*Primary Examiner* — Samuel G Gilbert

(74) *Attorney, Agent, or Firm* — Vorys, Sater, Seymour and Pease LLP

(57) ABSTRACT

Sexual stimulation devices including: (a) an inside arm configured to be placed within a vagina of a female; (b) an outside arm configured to be placed against a clitoral area of said female; and (c) a middle portion connecting said inside arm and said outside arm. Wherein the device is dimensioned to be worn with the inside arm inserted into the vagina of said female during intercourse, and wherein said inside arm includes an open center portion.

18 Claims, 14 Drawing Sheets

SEXUAL STIMULATION DEVICE

RELATED APPLICATIONS

This application claims the benefit of the filing date of U.S. Provisional Patent Application No. 61/503,679, filed on Jul. 1, 2011, the contents of which are incorporated herein by reference in their entirety. This application is also a National Phase application from PCT/CA2012/050442 filed Jun. 29, 2012 and published as WO/2013/003954A1. This application is also a Divisional application from U.S. application Ser. No. 14/129,761, which was filed Apr. 23, 2014, published as US2014/0228629, and which is incorporated herein by reference in its entirety.

FIELD OF THE INVENTION

The present invention relates to devices for sexual stimulation. In particular, the present invention relates to such devices that are capable of being worn while engaging in sexual intercourse.

BACKGROUND

There are numerous devices available for use by women for sexual stimulation. They include products that are entirely manually operated, and achieve stimulation by shape and/or texture, and products that are provided with internal motors that achieve stimulation by shape, texture and vibration. These latter devices, commonly referred to as vibrators, are usually phallus shaped, and are provided with a handle for manipulation in and around the genital region by a woman. As such, they can generally be used to stimulate only one area at a time. However, it is known that there are at least three distinct effective genital stimulation areas in most women, namely the clitoris and surrounding skin, the inner surface of the vagina, and the so-called G-spot, a nerve reflex area inside the vagina, along the anterior surface.

Further, some devices are incapable of being worn by a woman during sexual intercourse without the need for at least one of the couple holding onto the device to keep it secure. At least one device is described in U.S. Pat. No. 7,931,605 (which is incorporated herein by reference in its entirety), assigned to Standard Innovation Corporation, Inc., as being designed to be worn by a woman during sexual intercourse with a male partner. While this device, which is sold commercially as the We-Vibe™, was the first commercially available sexual device specifically designed and dimensioned to be worn by a woman during intercourse with a man, a need remains for an alternative device that can maintain its position, or that can better maintain its position, during intercourse and/or individual stimulation.

SUMMARY

An object of the present invention is to provide a sexual stimulation device dimensioned to be worn by a woman during sexual intercourse, in accordance with one aspect, the sexual stimulation device is an improvement over the device described in U.S. Pat. No. 7,931,605, the improvement being more position-stable during use, as well as providing an enhanced overall stimulating effect to the individual or partners using it. By significantly and selectively designing the shape and contour of the device to provide a more stable configuration during use, as well as allowing for various designs for creating vibratory stimulations, including surface area, surface area contours and motor placement, the overall ability of the presently described sexual stimulation device to enhance the sexual experience of a couple using the device may be improved in comparison to the device described in U.S. Pat. No. 7,931,605, or may provide an alternative user experience than the device described in U.S. Pat. No. 7,931,605.

In accordance with one aspect, there is provided a sexual stimulation device comprising: (a) an inside arm configured to be placed within the vagina of the female; (b) an outside arm configured to be placed against the clitoral area of the female; and (c) a middle portion connecting the inside arm and the outside arm; wherein the device is dimensioned to be worn by a female during intercourse and wherein the inside arm has a pair of opposed wing portions spaced apart from each side of a center portion of the inside arm, the outside edges of the wing portions defining a width of the inside arm. The wing portions can increase the surface area of the inner arm that comes into contact with the anterior wall of the vagina during use, in comparison to the surface area of the inner arm of the commercially available WeVibe® and/or the device described in U.S. Pat. No. 7,931,605. Alternatively, the wing portions serve to increase the ratios of the overall width of the inner arm to the depth and length of the inner arm, for example, in comparison to the ratio found in the commercially available We-Vibe® and/or the device described in U.S. Pat. No. 7,931,605, the wider aspect ratio improves stability of the device such that it is less likely to twist (rotate around its length axis) while in use.

During use, the wing portions provide positional stability and can permit vibratory dispersion over the surface of the device that is in contact with the sensitive nerve-containing tissue inside the vagina.

In accordance with another aspect, there is provided a sexual stimulation device comprising: (a) an inside arm configured to be placed within the vagina of the female; (b) an outside arm configured to be placed against the clitoral area of the female; and (c) a middle portion connecting the inside arm and the outside arm; wherein the device is dimensioned to be worn by a female during intercourse and wherein the inside arm has a raised center portion and a pair of opposed raised wing portions spaced apart from each side of the raised center portion, the raised wing portions defining a width of the inside arm. Optionally, the inside arm generally defines an hourglass shape when viewed in cross-section across its width, with the two wing portions having a greater depth than center portion of the inside arm.

In accordance with another aspect, there is provided a sexual stimulation device comprising: (a) an inside arm configured to be placed within the vagina of the female; (b) an outside arm configured to be placed against the clitoral area of the female; and (c) a middle portion connecting the inside arm and the outside arm; wherein the device is dimensioned to be worn by a female during intercourse and wherein the inside arm has an inwardly curved center portion and a pair of outwardly curved opposed wing portions spaced apart from each side of the center portion, the wing portions defining a width of the inside arm. In this aspect, the inner arm can form an overall convex shape.

In accordance with another aspect, there is provided a sexual stimulation device comprising: (a) an inside arm configured to be placed within the vagina of the female; (b) an outside arm configured to be placed against the clitoral area of the female; and (c) a middle portion connecting the inside arm and the outside arm; wherein the device is dimensioned to be worn by a female during intercourse and wherein the inside arm has an open center portion and a pair of outwardly curved opposed wing portions spaced apart from each side of the open center portion, the wing portions defining an outer perimeter of the inside arm.

In accordance with another aspect, there is provided a sexual stimulation device comprising: (a) an inside arm configured to be placed within the vagina of a female, said inside arm having a transition portion that tapers down toward the middle portion of the device and is inwardly curved toward the outer arm; (b) an outside arm configured to be placed against the clitoral area of said female; and (c) a middle portion connecting said inside arm and said outside arm, wherein said device is dimensioned to be worn by said female during intercourse.

In accordance with another aspect, there is provided a sexual stimulation device comprising: (a) an inside arm configured to be placed within the vagina of the female; (b) an outside arm configured to be placed against the clitoral area of the female; and (e) a middle portion connecting the inside arm and the outside arm, wherein the device is dimensioned to be worn by a female during intercourse and wherein at least two vibrational sources are disposed within the inside arm.

BRIEF DESCRIPTION OF THE FIGURES

For a better understanding of the present invention, as well as other aspects and further features thereof, reference is made to the following description which is to be used in conjunction with the accompanying drawings, where.

DETAILED DESCRIPTION OF' THE INVENTION

Figure 1:
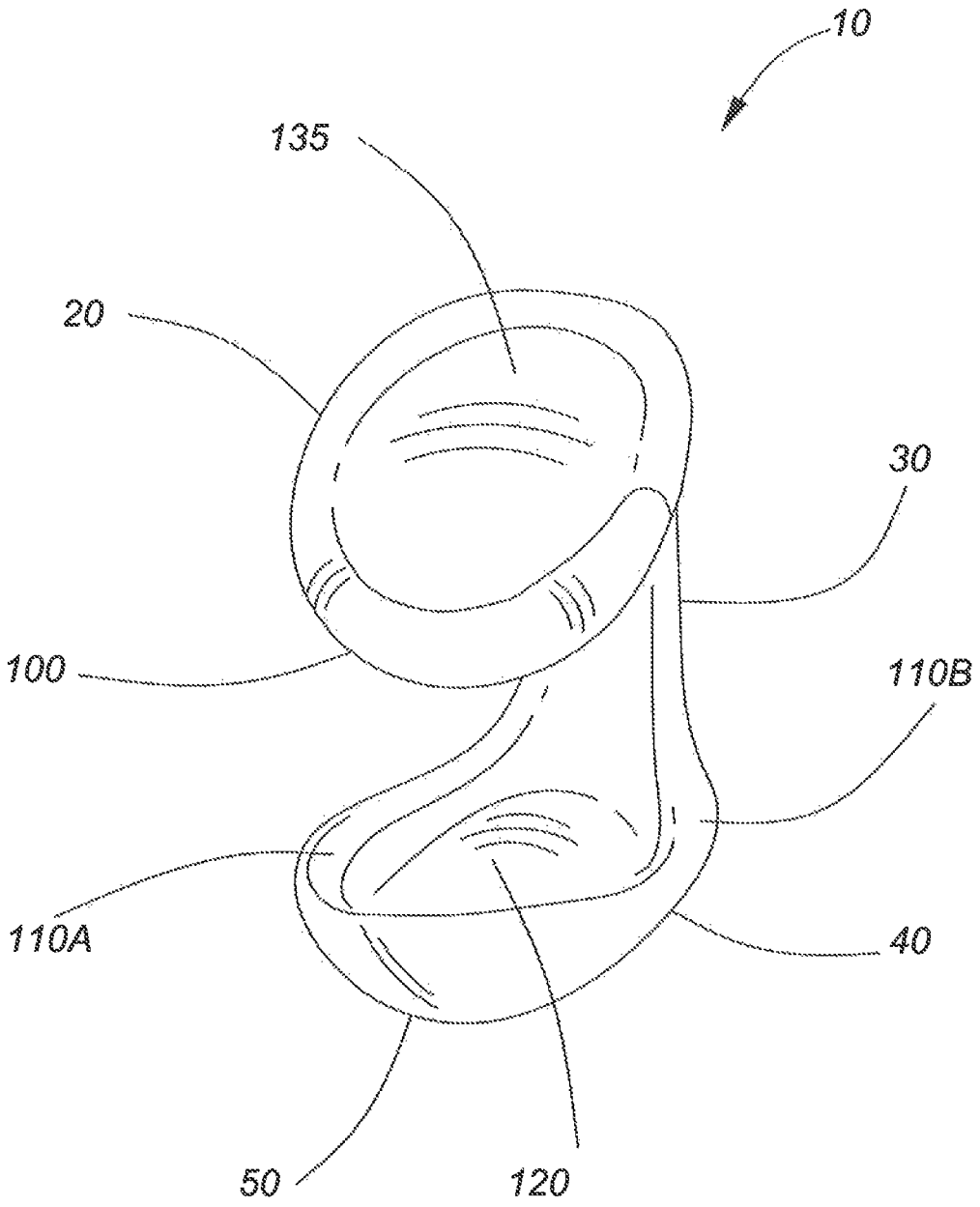
FIG. 1 is a front view of one embodiment of a sexual stimulation device as described herein.

Unless defined otherwise, all technical and scientific terms used herein have the same meaning as commonly understood by one of ordinary skill in the art to which this invention belongs.

Unless the context clearly indicates otherwise, as used herein, plural forms of the terms herein are to be construed as including the singular form and vice versa.

The terms "comprises" and "comprising," as used herein will be understood to mean that the list following is non-exhaustive and may or may not include any other additional suitable items, for example one or more further feature(s), component(s) and/or ingredient(s) as appropriate.

The term "woman," as used herein, refers to a female human. That is a woman is a human having a vagina. The terms "woman" and "female" are used interchangeably herein.

The term "flexible," as used herein, refers to the ability of a body that is capable of being bent or flexed. Something that is flexible can be, for example, resilient or malleable. The term "resilient," as used herein, refers to the ability of a body that has been subjected to an external force to recover, or substantially recover, its original size and/or shape, following deformation. The term "malleable," as used herein, refers to the ability of a body that has been subjected to an external force to deform and maintain, or substantially maintain, the deformed size and/or shape.

As used herein, the term "intercourse" has its common meaning and refers to coitus, or sexual union between a male and a female that involves insertion of the penis in the vagina.

The sexual stimulation device described herein is similar to that described in U.S. Pat. No. 7,931,605, in that it includes a first arm (the "inside" arm), configured (i.e., shaped and sized) for placement in a woman's vagina, a second arm (the "outside" arm), configured for contact with the clitoris, or clitoral area, of the female, and a middle portion that connects the first arm to the second arm. As described in U.S. Pat. No. 7,931,605, the present sexual stimulation device is sized and shaped for use by a female during sexual intercourse. As a result, the first arm and the middle portion of the device is appropriately sized and shaped to allow a man's penis to be inserted in the woman's vagina while she is wearing the sexual device. The first arm and the middle portion of the device are particularly sized and shaped to facilitate a pleasurable experience for both the man and the woman while the device is worn by the woman.

As would be readily understood by a worker skilled in the art, a device that is dimensioned to be worn by a woman during intercourse is one that is sized and shaped such that the inner arm is retained within the woman's vagina during intercourse, without the need for the device to be held in place, for example, by hand or by the use of ancillary restraints, such as straps. The specific dimensions of the present sexual stimulation device can be varied to correspond with and be comfortably worn by women having various anatomical dimensions. However, it should be understood that the size and shape of the present device is generally selected to allow the device to be comfortably worn by a majority of women.

The sexual stimulation device described herein additionally includes elements that can further improve the sexual experience for the man and/or woman during intercourse or can provide an alternative sexual experience for the man and/or woman during intercourse.

In accordance with one aspect of the application, the inside arm of the sexual stimulation device comprises a pair of opposed wing portions spaced apart from each side of the center portion of the inner arm, the outer edges of wing portions defining a width of the inside arm. The wing portions of the inner arm are thin and the center portion of the inside arm can have the same thickness as the wing portions, or can be thicker than the wing portions or the inside arm can have an open center portion. During use, the wing portions provide positional stability and can permit vibratory dispersion over the surface of the device that is in contact with the sensitive nerve-containing tissue inside the vagina, in particular, in the anterior wall of the vagina. In another aspect, there are at least two vibrational motors disposed within the inside arm. The at least two motors operate together or independently.

Figure 2:
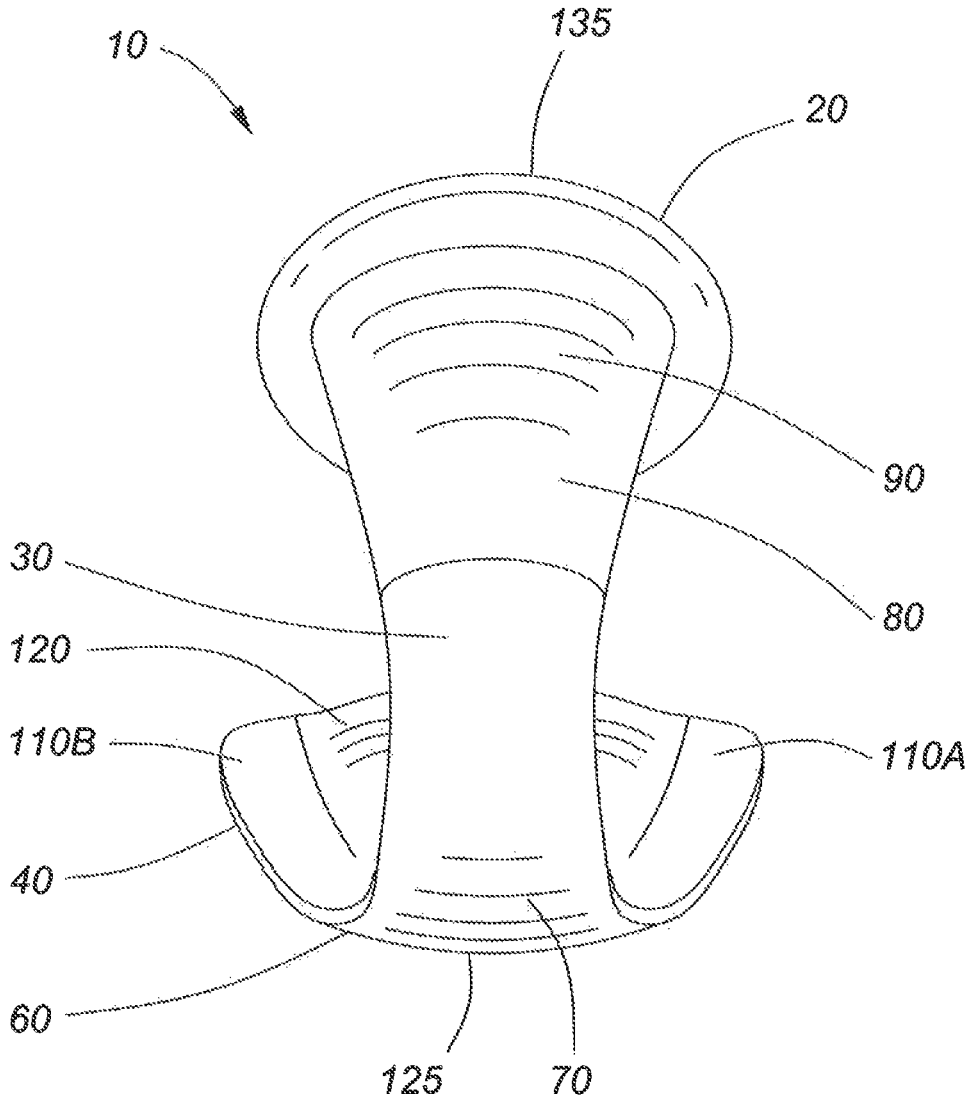
FIG. 2 is a rear view of the device shown in FIG. 1.
Figure 3:
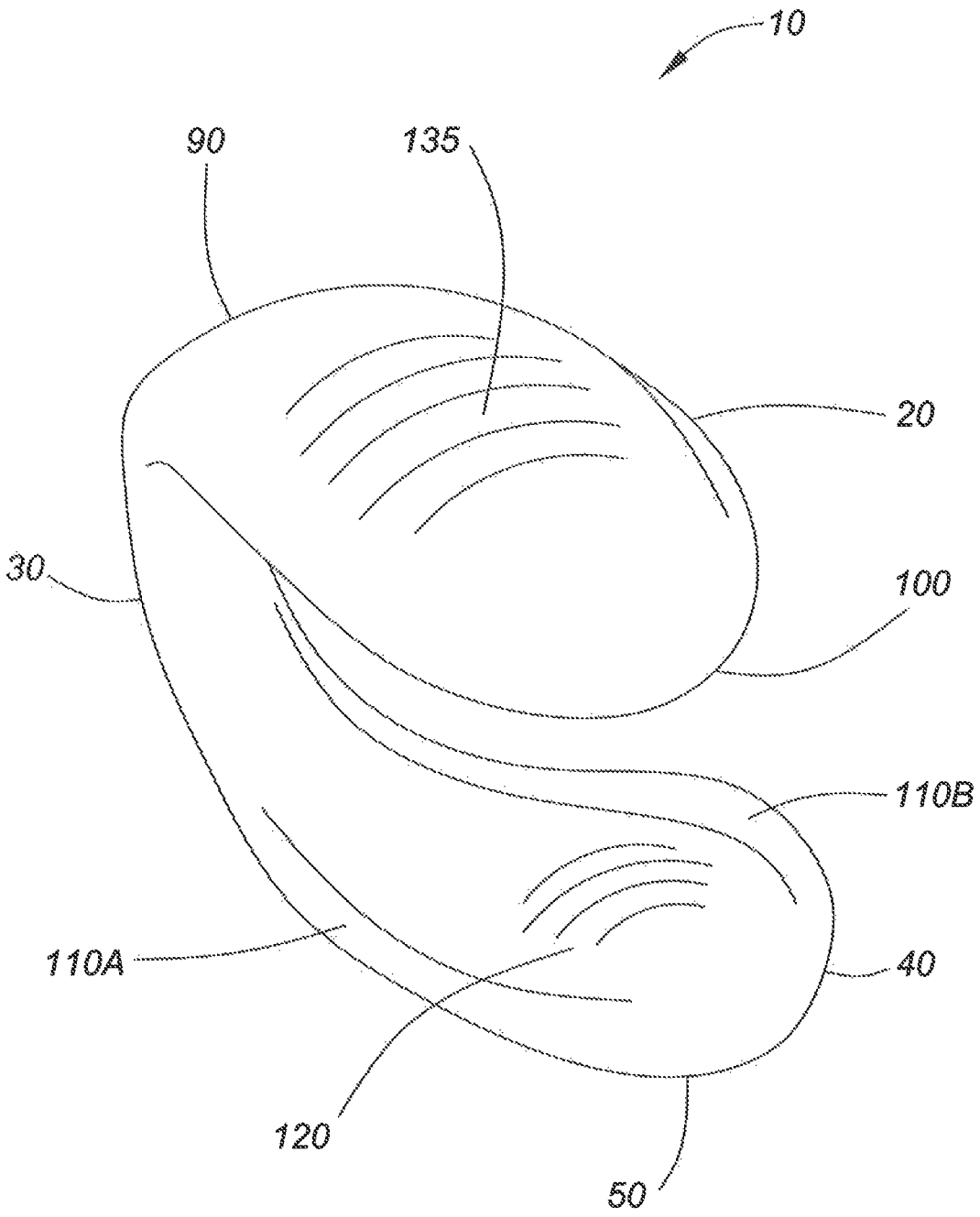
FIG. 3 is a front perspective view of the device shown in FIG. 1.
Figure 4:
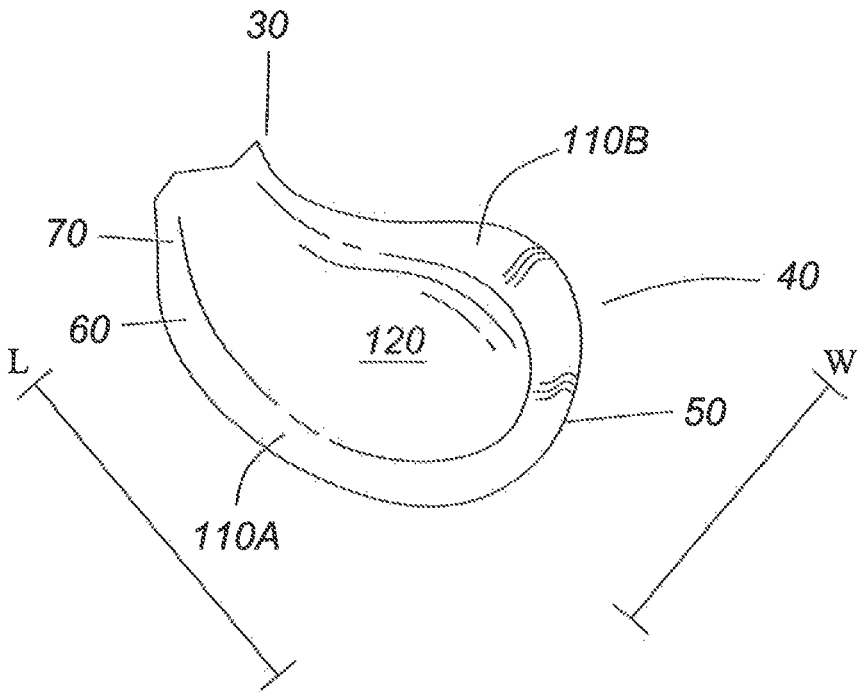
FIG. 4 is a close-up view of one example of an inside arm of a sexual stimulation device as described herein.

Referring now to FIGS. 1-3, in one embodiment there is provided a sexual stimulation device 10, which is flexible, and sized and shaped to be worn by a woman during intercourse. Device 10 can be resiliently flexible, that is, it will return to its original shape in the absence of force applied to it, or it may be malleable, such that it retains a new shape following application of force. Device 10 is sized and shaped to correspond with the size and shape of a woman's body, in particular, a woman's vagina, as will be explained in further detail below.

Device 10 generally includes outside arm 20, middle portion 30 and inside arm 40. Inside arm 40 is intended to be inserted into the woman's vagina during use, while outside arm 20 remains outside the woman's body and, for example, in contact with the woman's clitoris or clitoral area, and, optionally, tucked between the labia majora. The two anus (20, 40) are joined together via middle portion 30, which has a relatively thin, smooth profile so as to allow maximum comfort and not be obstructive to a man's penis during intercourse. Inside arm 40 can be dimensioned in a flat pad-like form, or it can have a raised portion 120 and raised wing portions 110A and 110B to provide stability and relatively large surface area in order to maximize contact with the g-spot and surrounding tissue of the anterior wall of the vagina. Inside arm 40 having wing portions 110A and 110B has a width that is sufficiently large to accommodate one or more vibrational motors, as will be described in more detail below, and is intended to be at least partially in contact with the region of the vagina near where the g-spot is located and desirably in substantial contact with the g-spot area. Thus, when in use, device 10 is capable of stimulating a woman's g-spot and inside surface of vagina (via inside arm 40) and simultaneously stimulating the clitoris (via outside area 20).

Inside arm 40 includes a first distal end 50, which is for insertion into a woman's vagina, and a first proximal end 60, for attachment of inside arm 40 to middle portion 30. The length ("L") of inside arm 40 is measured between first distal end 50 and first proximal end 60. Middle portion 30 includes inner end 70, which attaches to proximal end 60 of inside arm 40, and outer end 80, for attachment of middle portion 30 to outside arm 20. The length of middle portion 30 is measured between inner end 70 and outer end 80. Outside arm 20 includes a second distal end 90 and a second proximal end 100. The length of outside arm 20 is measured between second distal end 90 and second proximal end 100 of the outside arm 20. The outer end 80 of middle portion 30 is connected to second distal end 90 of the outside arm 20. Desirably, the connections between the middle portion 30 and the inside arm 40 and outside arm 20 are smooth and non-obtrusive. In particular, the connections do not include abrupt changes in size or shape. Preferably, outside arm 20 and inside arm 40 taper gradually down to connecting middle portion 30.

Device 10 can be generally "U" shaped in the absence of force acted thereon or, alternatively, device 10 can be generally "C" shaped in the absence of force acted thereon. In other words, when the product is not being worn for its intended purpose, its natural resting shape can have an overall shape that can be described as generally "C" or "U" shaped. Optionally, device 10 is capable of being opened up from its C or U shape, by movement of the inner and outer arms approximately 180° about the middle portion such that the two ends of the device are at their furthest position apart relative to one another. In some embodiments, the inner and outer arms can be opened up approximately 270°. In embodiments where device 10 is resilient, once opened up, the device will return to its original shape naturally, unless otherwise constrained. Such resiliency permits a snug fit against the body during use and allows for conformance to varying anatomies. In embodiments where the device is malleable, the shape of device 10 can be changed and will substantially retain its modified shape, thus allowing for use at a shape that is selected as being desirable by the user(s). The shape can be changed as desired. Inner arm 40 and middle portion 30 can be thin (e.g., low profile, or thinner than it is long or wide), allowing for ease in insertion of the device during use and lack of interference during sexual intercourse.

Figure 13:
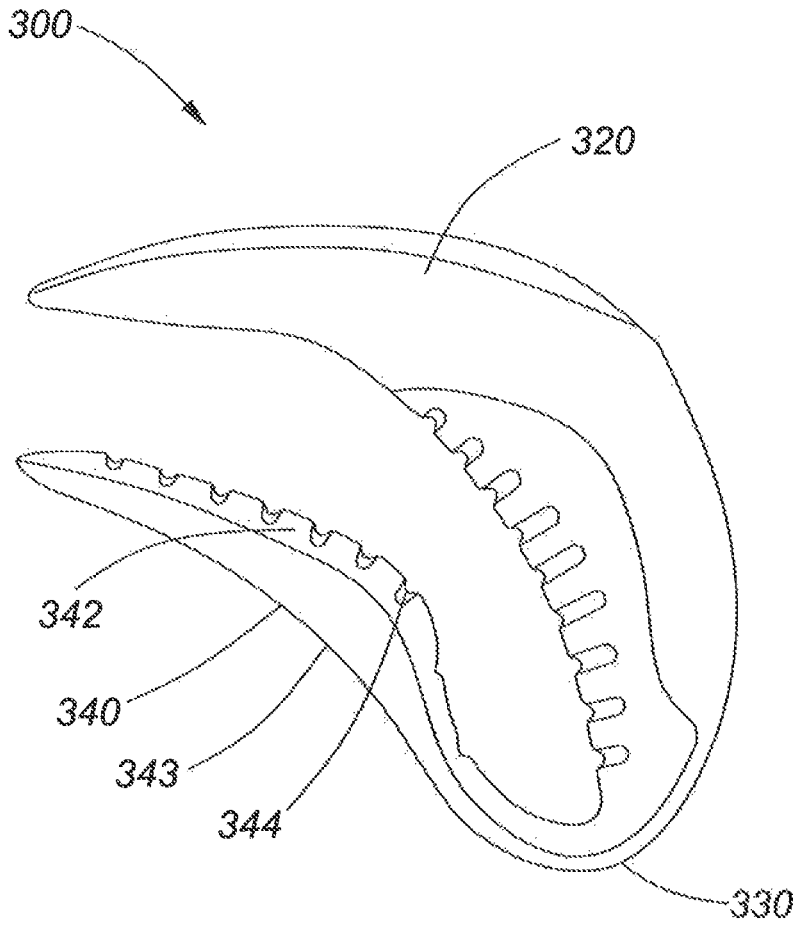
FIG. 13 is a side view of another embodiment of a sexual stimulation device having a transition portion as described herein.
Figure 14:
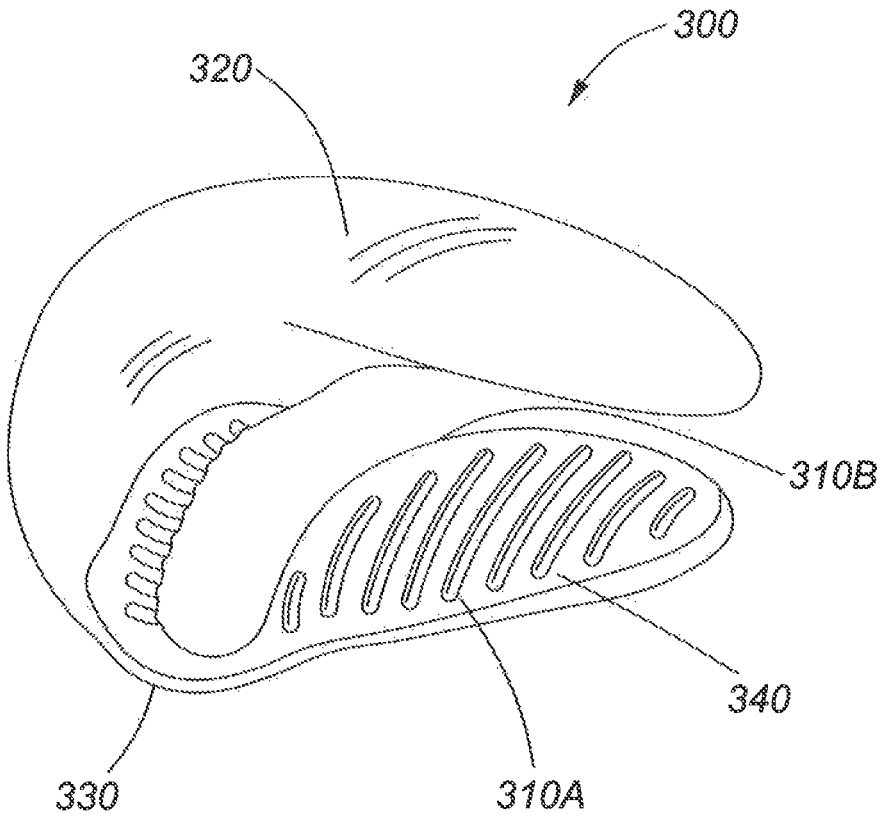
FIG. 14 is top side perspective view of the device shown in FIG. 13; [0016]
Figure 15:
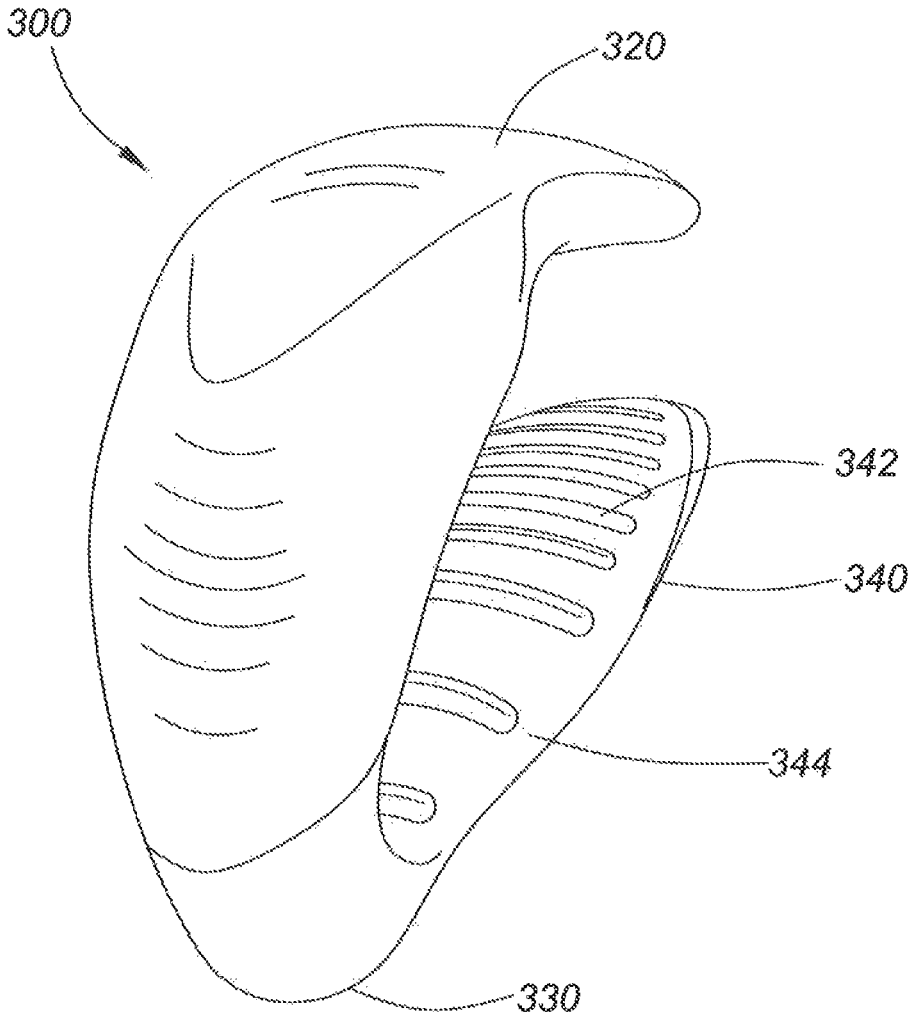
FIG. 15 is a rear perspective view of the device shown in FIG. 13.
Figure 16A:
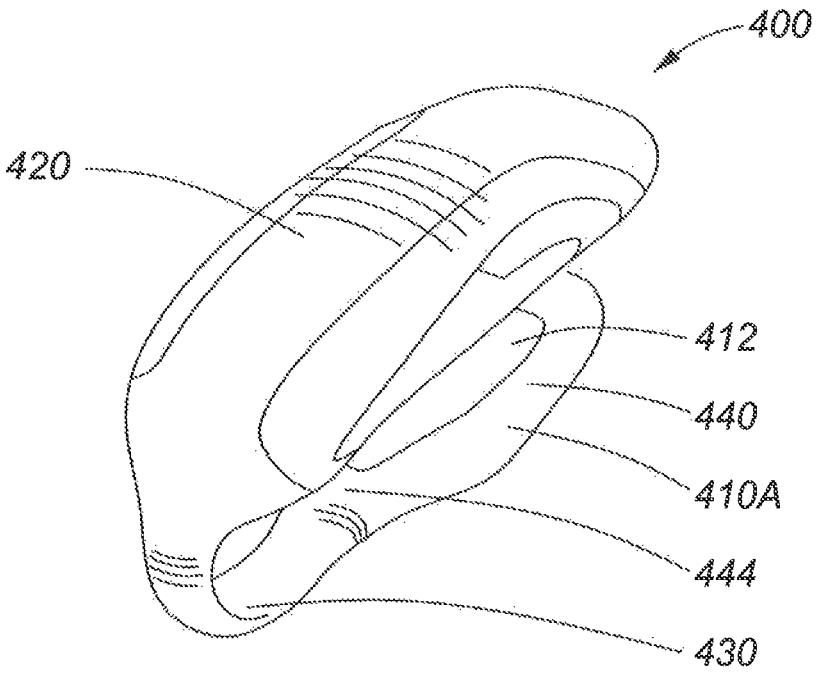
FIG. 16A is a top perspective view of another embodiment of a sexual stimulation device having an inside arm with a transition portion and an open center portion as described herein.
Figure 16B:
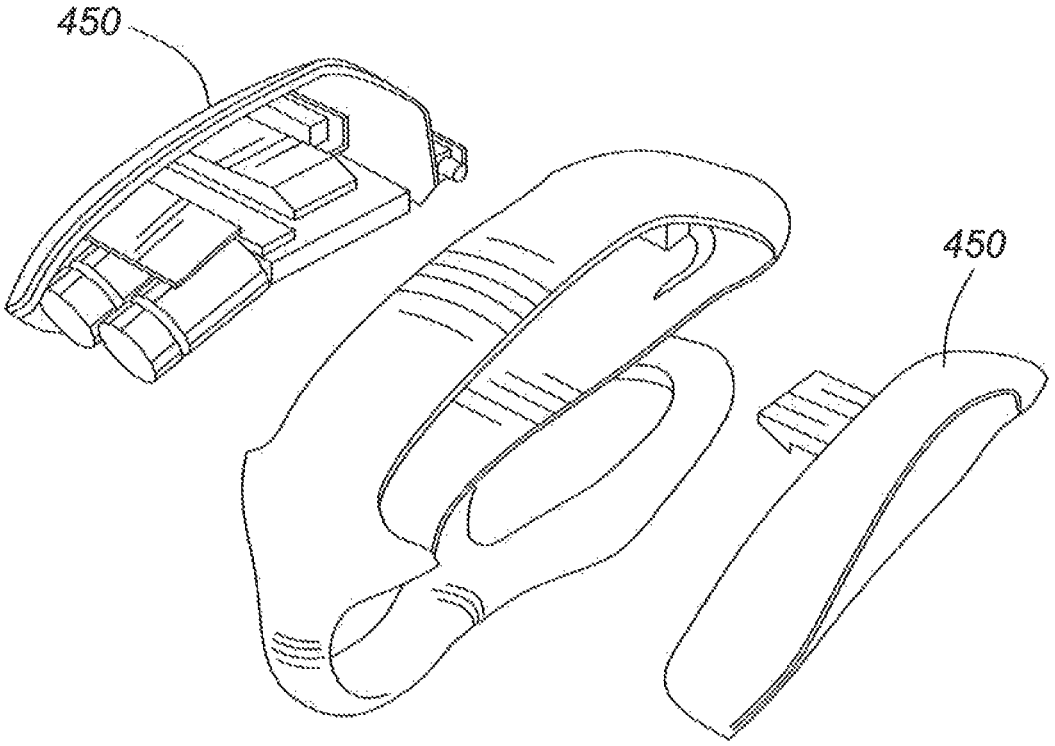
FIG. 16B is an exploded, top perspective view of the device shown in FIG. 16A.
Figure 17:
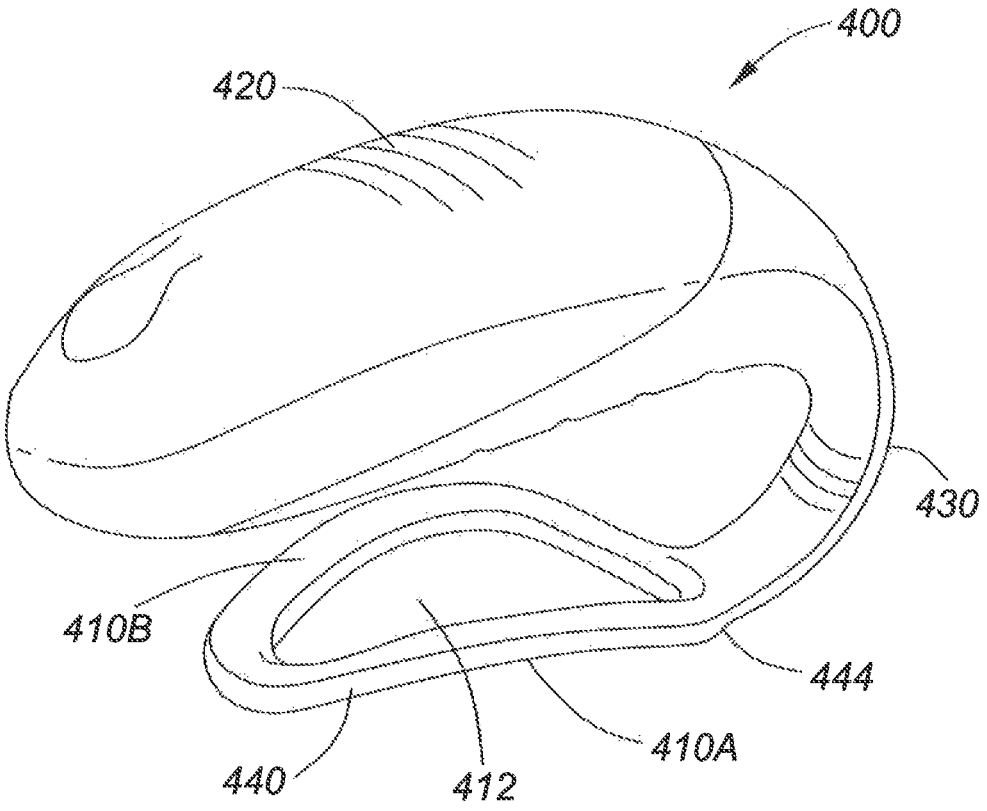
FIG. 17 is a top perspective view of another embodiment of a sexual stimulation device having an inside arm with a transition portion and an open center portion as described herein.
Figure 18A:
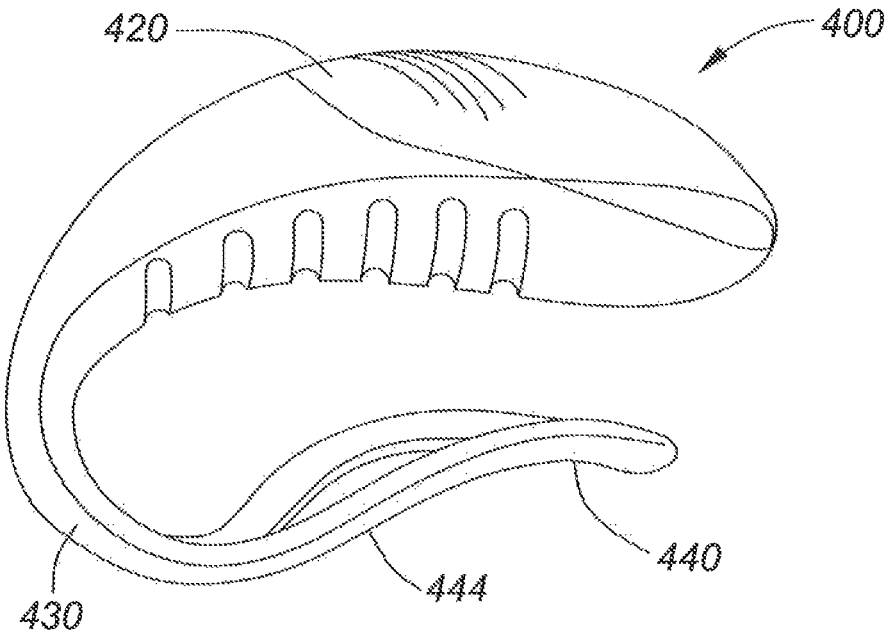
FIG. 18A is a side view of the device shown in FIG. 17.
Figure 18B:
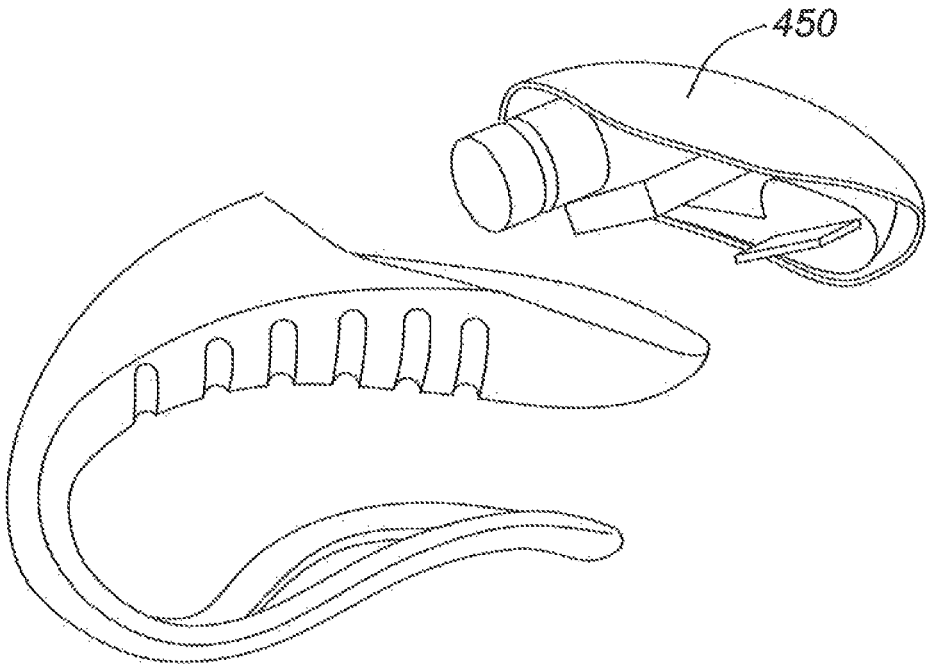
FIG. 18B is an exploded view of the device shown in FIG. 18A.

Another embodiment of the present sexual stimulation device is depicted in FIGS. 13-15. In this embodiment, the device includes an inside arm that comprises an additional stabilization element. Device 300 generally includes outside arm 320, middle portion 330 and inside arm 340. Inside arm 340 is intended to be inserted into the woman's vagina during use, while outside arm 320 remains outside the woman's body and, for example, in contact with the woman's clitoris or clitoral area, and, optionally, tucked between the labia majora. The two arms (320, 340) are joined together via middle portion 330, which has a relatively thin, smooth profile so as to allow maximum comfort and not be obstructive to a man's penis during intercourse. Inside arm 340 comprises pad 342 for contact with the anterior wall of the vagina during use. Pad 342 of inside arm 340 comprises a center region and wing portions 310A and 310B to provide stability and relatively large surface area in order to maximize contact with the g-spot and surrounding tissue of the anterior wall of the vagina. Inside arm 340 having wing portions 310A and 310B has a width that is sufficiently large to accommodate one or more: vibrational motors, as will be described in more detail below, and is intended to be at least partially in contact with the region of the vagina near where the g-spot is located and desirably in substantial contact with the g-spot area. Thus, when in use, device 300 is capable of stimulating a woman's g-spot and inside surface of vagina (via inside arm 340) and simultaneously stimulating the clitoris (via outside arm 320).

Inside arm 340 of device 300 comprises a transition portion 344 that includes a taper down from pad 342 to the connecting middle portion 330. In addition, transition portion 344 is inwardly curved toward outer arm 320 such that, in use, device 300, gently hooks around the woman's pelvic bone to provide additionally stability. When viewed from the side, as in FIG. 13, it can be seen that transition portion 344 generally forms a reverse curve extending from the "C" or "U" shape of middle portion 330. The specific curvature of transition portion 344 can be varied to accommodate various female anatomical dimensions. However, as with the dimensions of the rest of device 300, the size and curvature of transition portion 344 is generally selected to allow the device to be comfortably worn by a majority of women, A further embodiment of the present sexual stimulation device is depicted in FIGS. 16-18B. In this embodiment, device 400 comprises inside arm 440 that includes transition portion 444 that is dimensioned to hook around the woman's pelvic bone and further includes narrow wing portions 410A and 410B around an open center portion 412. In this embodiment, wing portions 410A and 410B define an overall width of inside arm 440 that function to provide positional stabilization of device 400 when inserted in a woman's vagina. Open center portion 412 allows manufacture of a device with reduced cost because of the reduction in required material. Furthermore, the configuration of this embodiment can also allow the woman to feel movement of the man's penis on the anterior wall of the vagina during intercourse.

Inside Arm

As described above, the device of the present application includes an inner arm having two opposed wing portions located on either side of a center portion of the inner arm as it extends away from the middle portion of the device. Overall, the inner arm tapers from its widest portion (as measured between the outer edges of the wings) and narrows down to the connecting middle portion of the device. This configuration minimizes obstruction at the entrance to the vagina to allow entry of the man's penis into the woman's vagina while she is wearing the present device during intercourse, while also providing some degree of positional stabilization during use.

Figure 5:
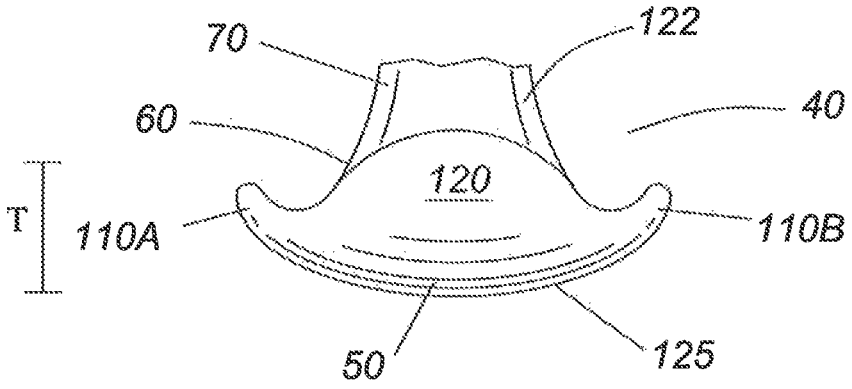
FIG. 5 is a front view of the inside arm shown in FIG. 4.

With particular reference to FIGS. 1 and 5, inside arm 40 can include a raised center portion 120 and a pair of opposed raised wing portions 110A, 110B spaced apart from each side of the raised center portion 120. The distance between the raised wing portions 110A, 110B defines the width ("W") of inside arm 40. Inside arm 40 includes an interior surface 122 and an exterior surface 125, where, upon insertion into the woman's vagina, interior surface 122 is at least partially in contact with the anterior wall of the vagina. The thickness ("T") of inside arm 40 is measured between the interior surface 122 and the exterior surface 125. During sexual intercourse, when the device 10 is inserted, the exterior surface 125 is in contact with the man's penis. Opposed wing portions 110A/B and raised center portion 120 are raised towards interior surface 122 of inside arm 40, creating a "valley" between raised center portion 120 and each wing portion 110A/B.

Wing portions 110A/B are useful for a variety of functions, including, for example, retaining the device in place during use. The present inventor has discovered that, without the wing portions 110A/B, and because middle arm 30 is flexible, and inside arm 40 is only slightly wider than its thickness, inside arm 40 is sometimes susceptible to rolling during use. During use, it can arise that inside arm 40 twists up to 90 degrees, resulting in the penis going beside the inside arm 40. This is uncomfortable for the user, and further, it has been discovered that the twisted inside arm 40 torques middle arm 30, which results in outer arm 20 coming out from the central position over the clitoral area. The presence of the wing portions 110A/B create a wider inside arm 40, which resists twisting and moving during use, and therefore increases comfort during use and maintains the various portions of the device 10 in place.

In addition, the use of wing portions 110A/B that are thinner (in depth or thickness) than the central portion of inner arm 40, allows device 10 to have a wider inside arm 40, without also increasing the thickness. The result is a device 10 that is wide enough to resist twisting inside the woman, but is thin enough to allow for comfortable use during intercourse. Winged portions 110A/B can be resilient or malleable, or can be formed from a combination of resilient and malleable parts.

In a specific example, raised center portion 120 has a width that is at least 50% of the width of inside arm 40, or at least 75% of the width of inside arm 40.

Figure 6:
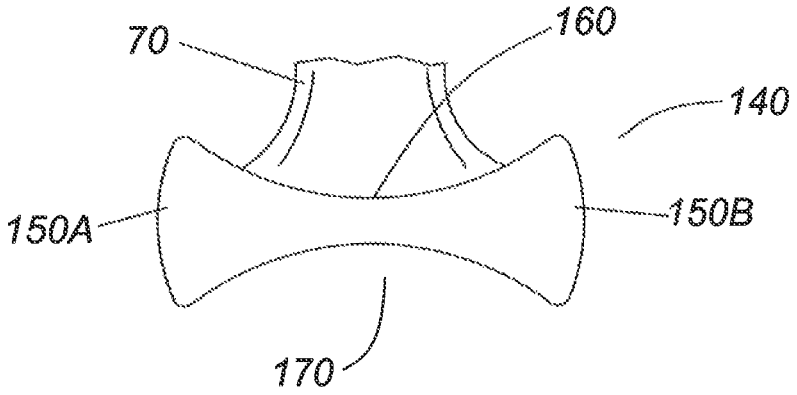
FIG. 6 is a front view of an alternate example of an inside arm of a sexual stimulation device as described herein.

In an alternative embodiment, depicted in FIG. 6, the sexual stimulation device includes inside arm 140, which has a modified "hourglass" shape when viewed in cross-section. As with the previous embodiment, inside arm 140 includes a pair of opposed raised wing portions 150A and 150B, but lacks a raised center portion. Instead, the middle portion is concave having wings on both sides of the concave portions. That is, the interior surface 160 of the inside arm 140 is concave, and additionally the exterior surface 170 of the inside arm 140 is concave. In this embodiment, when worn during use, interior surface 160 of inside arm 140 is adjacent to the anterior wall of the vagina at the wing portions 150A/B. The exterior surface 170 of inside arm 140 is in contact with the penis during sexual intercourse. The concave portion in contact with the penis during use is defined on either side by wings to complete the approximately hourglass shape.

In an alternative embodiment, depicted in FIGS. 13-15, inside arm 340 comprises wing portions 310A and B that generally form a rounded or elliptical wing structure having a greater upper camber (i.e., toward outside arm 320) than lower camber. Inside arm 340 is further curved such that it forms a slightly convex shape on outer face 343 and tapers toward the distal end (approximating an inverted teaspoon-like shape). As also described above, inside arm 340 comprises transition portion 344 that includes a taper down from pad 342 to the connecting middle portion 330 and is inwardly curved toward outer arm 320 such that, in use, device 300, gently hooks around the woman's pelvic bone to provide additional stability. When viewed from the side, as in FIG. 13, it can be seen that transition portion 344 generally forms a reverse curve extending from the "C" or "U" shape of middle portion 330.

In another alternative embodiment, depicted in FIGS. 16-18B, inside arm 440 comprises a similar overall shape to the embodiment shown in FIGS. 13-15. In this embodiment, however, inside arm 440 comprises open center portion 412. The actual shape and size of the open center portion can vary, provided that wing portions 410A and B are sufficiently strong to provide internal support for the device when in use. Strength can be increased by, for example, increasing the thickness and width of the wing portion and/or through the use of more rigid materials in the inside arm.

The inside arm of the sexual stimulation device can take any number of shapes, and can include, for example, generally rounded or chamfered corners or edges, as desired. In some embodiments, external surface 125 of the inside arm 40 is concave, convex or generally flat. Internal surface 122 of inside arm 40 can likewise be concave, convex or generally flat. In some embodiments, the proximal end 60 of the inside arm can be tapered towards the middle portion 30, or it may be non-tapered.

The dimensions of inside arm 40 are selected to maximize comfort, internal stimulation and/or positional stability during use. The exact dimensions will vary depending on, for example, the user population, user preferences or manufacturing requirements.

In a specific, non-limiting example, the length of inside arm 40 is between about 35 mm and about 150 mm, or between about 60 mm and about 120 mm, or between about 60 mm and about 75 mm or it is approximately 65 mm or approximately 70 mm. It will be understood that every woman's body is different, and a shorter or longer length can be selected based on a woman's anatomy, or the average anatomical dimensions of a user population.

In another specific, non-limiting example, the width of inside arm 40 is between about 10 mm and about 80 mm, as measured from the widest point of the outer most edge of each of the winged portions 110A/B, or the width is between about 25 mm and about 60 mm, or it is approximately 40 mm.

In another specific, non-limiting example, the thickness of inside arm 40 is from about 1 mm to about 40 mm, as measured from the interior surface 122 at the raised center portion 120 to the exterior surface 125, or it is from about 10 mm to about 30 mm, or approximately 16 mm.

In determining the specific dimensions of inside arm 40, it can be useful to also consider the relative dimensions of the device. For example, the ratio of the thickness of inside arm 40 to the width of inside arm 40 can be from about 1:1.5 to about 1:5. Alternatively, the thickness of inside arm 40 is less than the width of inside arm 40, i.e., from about 1:2 to about 1:5. The ratio of the thickness of inside arm 40 to the length of inside arm 40 can be from about 1:1 to about 1:100, or from about 1:1 to about 1:50. The ratio of the length of inside arm 40 to the width of inside arm 40 can be from about 1:1 to about 1:2.

It should be recognized, however, that depth or thickness can vary within the inside arm. In accordance with a specific embodiment of the present device, the inside arm comprises a low profile center portion and thicker wing portions (see, for example, FIG. 6). One example of such an embodiment is the inside arm having a generally hourglass-like shape when viewed in cross-section (see FIG. 12). In an alternative embodiment, the inside arm comprises a pair of opposed wings each having a low profile. In one example of this embodiment, the inside arm comprises a thicker center portion, such as a raised center portion as shown in FIG. 5, or the slightly thicker curved center portion as shown in FIG. 13. In order to facilitate ease of use and comfort during insertion, the inside arm of the present sexual stimulation device comprises (i) a low profile center portion; (ii) a pair of low profile wing portions; or (iii) both. The term "low profile", as used herein, is intended to refer to a low depth to width ratio.

Middle Portion

Figure 7:
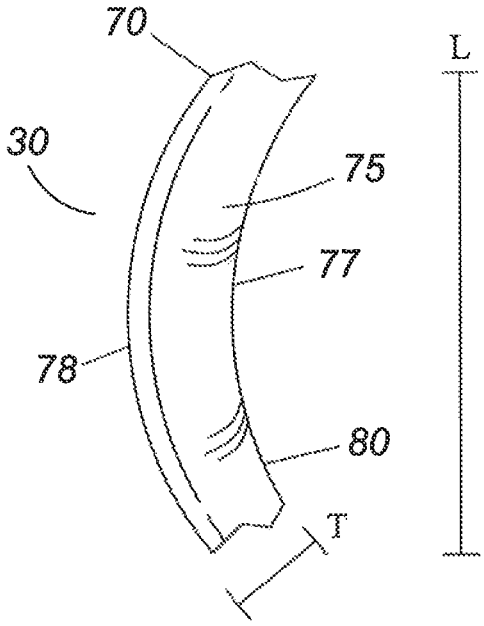
FIG. 7 is a side view of one example of a middle portion of a sexual stimulation device as described herein.
Figure 8:
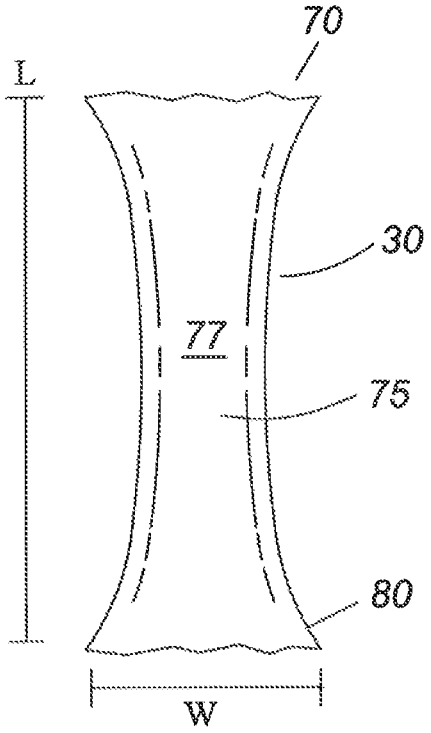
FIG. 8 is a front view of one example of a middle portion of a sexual stimulation device as described herein.

With reference to FIGS. 7-8, middle portion 30 has a length that is measured from inner end 70 to outer end 80, and center region 75. The middle portion 30 has an interior surface 77, configured to rest against the woman's body upon insertion, and an opposed exterior surface 78. The thickness is measured from interior surface 77 to exterior surface 78. The width of the middle portion is measured between the two side edges, as device 10 is viewed from the front as depicted in FIG. 8.

The dimensions of the middle portion 30 can be modified as desired so as to provide the desired level of comfort during use. It will, of course, be understood that these dimensions can be modified to suit a woman's body, or the average dimensions and shapes of women' bodies. It is particularly desired that the thickness of the middle portion 30 be kept as small as possible, so as to avoid disruption, discomfort or obstruction during sexual intercourse. In a specific example, the thickness of middle portion 30 can be from about 0.5 mm to about 10 mm, or from about 0.5 mm to about 2 mm. Middle portion 30 can have a length of from about 2.0 mm to about 250 mm, or from about 50 mm to about 200 mm, or approximately 70 mm. In addition, middle portion 30 desirably has a width (W) that is small enough to allow the device to be used during intercourse, without causing discomfort. Middle portion 30 optionally has a width from about 5 mm to about 40 mm, or from about 10 mm to about 25 mm, or approximately 14 mm.

The dimensions of middle portion 30 are selected to maximize comfort, flexibility and/or positional stability during use. The exact dimensions will vary depending on, for example, the user population, user preferences or manufacturing requirements.

As above, when determining the specific dimensions of middle portion 30, it can be useful to also consider the relative dimensions of the device components. For example, the ratio of the thickness of middle portion 30 to the length of middle portion 30 can be from about 1:1 to about 1:100, or from about 1:10. It can be particularly beneficial to have a thickness of middle portion 30 that is less than the width of middle portion 30.

In some embodiments, middle portion 30 can have a thinner width at the center 75 than at either of the inner end 70 or outer end 80, such that it has a biconcave center region (e.g., forming an approximate hourglass shape). That is, middle portion 30 may have a slight hourglass shape when viewed from the front of the device. The center 75 can have a width that is about 1-10% smaller than at either or both of the inner end 70 or outer end 80. In addition, the center 75 can have a thickness that is about 1-10% smaller than at either or both of the inner end 70 or outer end 80. Alternatively, middle portion 30 can have substantially parallel sides along its width and/or along its length. The edges of middle portion 30 can be, for example, straight, curved or wavy.

When viewed from the side in its resting condition, middle portion 30 of device 10, as depicted in FIGS. 3 and 7, for example, has a curved shape between the inner end 70 and outer end 80. This curved shape can provide device 10 with a generally "U" or "C" shape in its resting condition (i.e., when not influenced by an external force, such as, during use). In one embodiment, middle portion 30 maintains an angle of from about 25° to about 90° in its resting state. Middle portion 30 is flexible in order to permit positioning of the device according to the preference of the users. For example, middle portion 30 can be movable from its initial angle of between about 25° and about 90° to an angle greater than 25°, including up to about 35°, about 45°, about 55°, about 65°, about 75", or about 85°, or to an angle greater than 90°, including up to about 135°, about 180°, about 225°, or about 270°.

Middle portion 30 is either resilient or malleable. The material or combination of materials used to make middle portion 30 is selected, at least in part, based on the level of force required to move middle portion 30 from its resting condition. In the embodiment in which middle portion 30 is resilient, device 10 can be bent or extended for insertion into the woman, while the resilient force acts to maintain device 10 in place during use. It is desirable that middle portion 30 not be rigid, but rather allow at least some degree of flexibility for use.

As described above, middle portion 30 connects inside arm 40 to outside arm 20. Thus, middle portion 30 includes at least two transition regions; one at the connection between middle portion 30 and inside arm 40, and one at the connection between middle portion 30 and outside arm 20. Optionally, middle portion 30 includes more than two transition regions. A transition region includes a change in size and or shape. As will be understood by those of skill in the art, during sexual intercourse, the inner end 70 of the middle portion 30 and the proximal end 60 of the inside arm 40 are subjected to repeated contact with the penis. For this reason, it is desirable that the transition therebetween include a gradual change in size and shape so as to facilitate a comfortable and pleasurable experience. FIGS. 11A-11F depict various transitions between the two regions, as viewed from the side of the device. Although the figures are representative of the transition between the middle portion 30 and the inside arm 40, it should be understood that similar transitions can be used to connect middle portion 30 and outside arm 20.

Figure 11A:
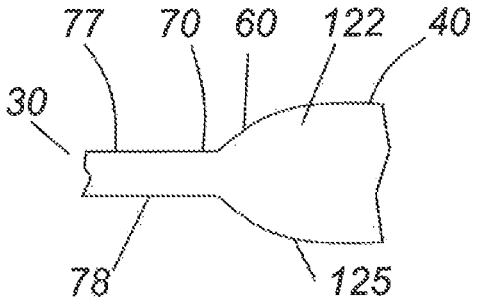
FIGS. 11A-11F depict various connections of a middle portion to an inside arm of a sexual stimulation device as described herein.
Figure 11B:
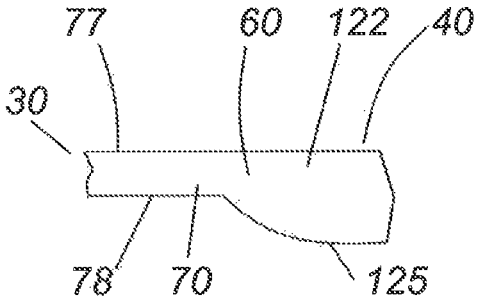
Figure 11C:
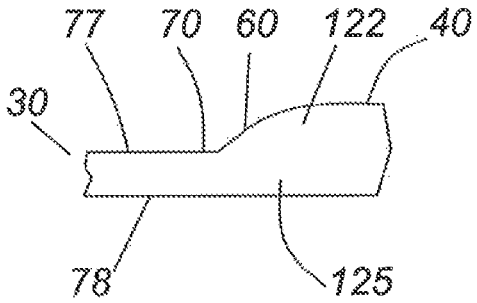

As can be seen in the Figures, many variations of connection transitions can be incorporated in device 10. FIG. 11A, for example, depicts connection of middle portion 30 to the inside arm 40 at a location substantially in the middle of the inside arm 40, that is, at a location between the interior surface 122 and the exterior surface 125 of the inside arm 40. This transition is termed a "partial transition". FIG. 11B, depicts a transition where interior surfaces 77, 122 are flush with each other. This provides a smooth transition on the interior surface, which is substantially in contact with the body of the woman. This transition is referred to as a "full transition", since the interior surfaces of middle portion 30 and the inside arm 40 are flush with each other. Another example of a transition is set forth at FIG. 11C, where exterior surfaces 78, 125, are flush with each other. This configuration provides a smooth transition on the exterior surface, where the device will be substantially in contact with the man's penis during intercourse. Again, since the surfaces (exterior surface 78 and 125) are flush with each other, this is a "full transition".

Figure 11D:
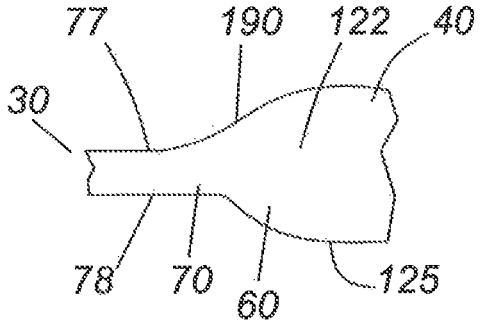
Figure 11E:
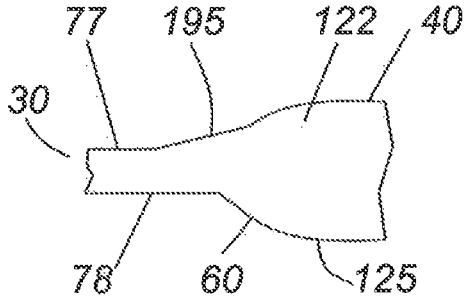
Figure 11F:
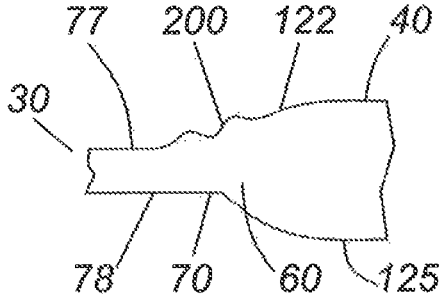

FIG. 11D shows a transition including a full taper 190, which extends from the internal surface 77 of the middle portion 30 to the internal surface 122 of the inside arm 40. A full taper 190 can be used to provide a smooth and non-obtrusive transition. FIG. 11E depicts a partial taper 195, extending from the interior surface 77 of the middle portion 30 to a point at the proximal end 60 of the inside arm 40. FIG. 11F is representative of the various configurations that a taper (190/195) may take, and in the Figure shows a wavy taper 200. Other configurations for the taper 200 can be used, including stepped, bumpy, and the like.

As explained above, middle portion 30 desirably includes a curve to provide the device 10 with a general "C" or "U" shape. The curved portion of the middle portion 30 begins at inner end 70 or at outer end 80, or alternatively middle portion 30 is free of a curve at either end (70, 80). In some embodiments, middle portion 30 is approximately straight at either end (70, 80) for approximately 1-5% of the length of the middle portion 30, and then incorporates curves.

Outside Arm

Outside area 20 is configured for contact with a woman's clitoris and/or the surrounding clitoral region, in order to provide clitoral stimulation during use. Outside arm 20 has an interior surface 130 and an exterior surface 135, where interior surface 130 is designed to be in at least partial contact with a woman's clitoral region during use, and in particular, in at least partial contact with the clitoris during use.

Figure 9:
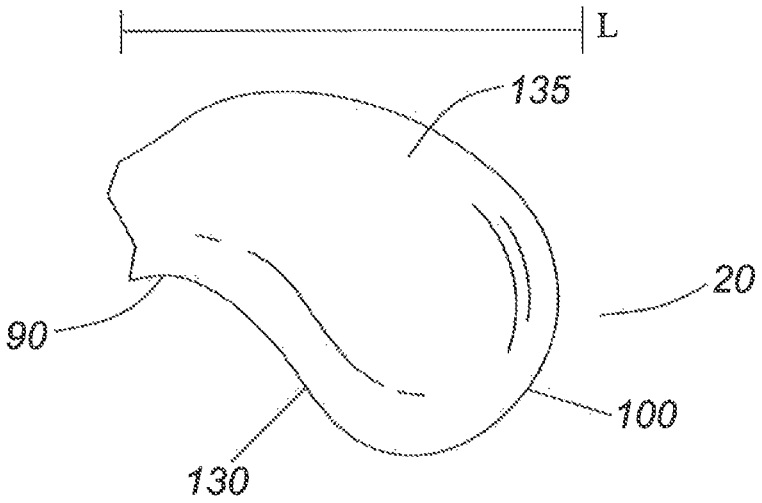
FIG. 9 is a side view of one example of an outside arm of a sexual stimulation device as described herein.
Figure 10:
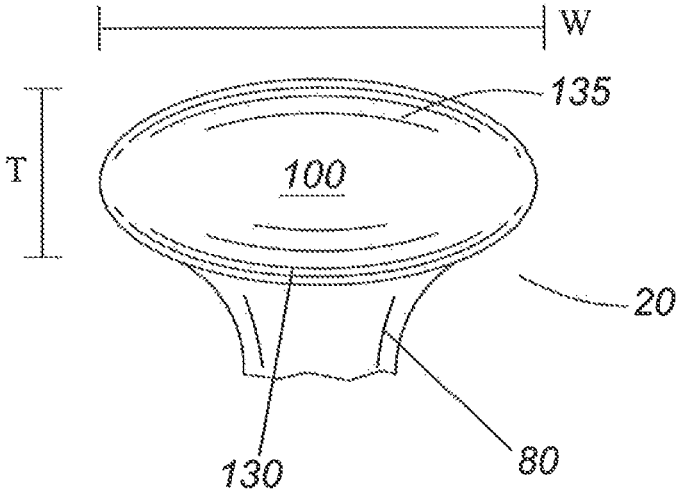
FIG. 10 is a front view of the outside arm shown in FIG. 9.

As depicted in FIGS. 9-10, outside arm 20 has a length measured from the distal end 90 to proximal end 100. The thickness of the outside arm 20 is measured from the interior surface 130 to the exterior surface 135. The width of the outside arm 20 is measured between the side edges, as seen in the frontal view shown in FIG. 10. In accordance with one non-limiting embodiment, outside arm 20 has a thickness of from about 5 mm to about 50 mm, or about 20 mm, a width of from about 5 mm to about 100 mm, or about 30 mm, and a length of from about 20 mm to about 2.50 mm, or about 70 mm.

The dimensions of outside arm 20 are selected to maximize comfort, stimulation and/or positional stability during use. The exact dimensions will vary depending on, for example, the user population, user preferences or manufacturing requirements.

Interior surface 130 of outside arm 20 can be substantially flat, or it can be convex. Alternatively, interior surface 130 of outside arm 20 includes wing portions.

Additional Features and Components

The present sexual stimulation device and its parts can be made of any compliant, non-toxic material, such as, for example, those materials set forth in Applicant's co-pending U.S. Publication No. 2008/0009775, published Jan. 10, 2008, the entire contents of which are incorporated by reference herein. In particular, the outer surfaces of the device can be made of materials such as elastomer, silicone, vinyl, rubber (e.g., a urethane rubbery, glass, plastic, among others, or combinations thereof. Optionally, the outer surfaces of each part of the device are as smooth as possible, and desirably glass-smooth, too ensure a pleasurable experience by the user. The device can be any color or combination of colors, can be clear or opaque, or a combination, and can include designs and/or logos thereon.

Device 10 comprises an internal skeleton, formed from, for example, molded plastic and/or pre-shaped metal (such as copper, a memory alloy or the like) so that use of a very soft silicone body can be suitably used. The internal skeleton of device 10 can be made from shape memory alloys, such as TiNi, malleable metals, resilient metals or from other non-metals, such as elastomeric polymers, nylon, or polyurethane. A metal skeleton can be useful in providing a malleable device, which retains its shape after the application of force thereon. In some embodiments, the use of shape memory alloys can be useful in providing a resilient device, which springs back to original shape after application of force is removed. Examples of useful metals include, but are not limited to, nitino and, stainless steel. Polymers useful in the internal skeleton include, without limitation, polypropylene, polyethylene, polymethacrylies, and combinations thereof. Combinations of polymeric and metallic internal skeletons are also useful.

Further, the device can include electrical materials or components inside the outer surfaces, including wires, batteries and motor(s). The wiring and circuitry can include those components set forth in the above-incorporated U.S. Publication No. 2008/0009775.

The present sexual stimulation device includes a power means or source, for example, a rechargeable battery housed within the device or one or more disposable batteries. In some embodiments, the rechargeable battery is located in the outside arias, and includes an outlet for recharging the battery. In other embodiments, the rechargeable battery in the device can be inductive charged.

In addition, the device comprises a switch means to not only turn on and off the vibrational source(s), but to control the type and strength of vibration of device 10 during use.

The electronic components of the device are desirably located within the inner skeleton of the device, which is covered by the outer layer of nontoxic material, as described above. The external components of the device should be free of defects, holes, or other openings, so as to effectively protect the electronic components housed therein and, optionally, to ensure the device is waterproof or water resistant. Although the surfaces of the device of the present application can be smooth, in some embodiments, the device includes one or more textured surfaces. For example, the interior surface of the outside arm can be textured, such as having raised bumps, raised waves, raised concentric circles, nubbies, or any other texture desired. Similarly, the interior surface or the exterior surface of the inside arm can also be textured.

Further, any portion of the device of the present application can be resilient or malleable. It is not necessary for the entire device to be either resilient or malleable; rather, in some examples, only a certain part, or parts, of the device are resilient or malleable. For example, the inside arm can be malleable while the middle portion is resilient. Any combination of resilient portions and malleable portions are useful in the invention, depending upon the desired use and feel. It is particularly desirable that at least a portion of the middle portion be resilient, so that the inner and outer arms of the device are consistently biased toward one another to help maintain the device in place during use and to exert a forward pressure on the g-spot and surrounding tissue via the inside arm.

The device of the present application is provided with an internal or external power source that provides power to at least one independently operating motor. The motor or motors, if multiple motors are used, can be operated to create a harmonic vibration in the device. It can be especially preferable to use vibrational sources that provide a harmonic pulsation in at least one component of the device, due to various interactions between the vibrations produced by motors within the device.

Optionally, the device of the present application includes one or more vibrational sources, for increased stimulation during use. For example, one or more vibrational sources can be disposed in any or all of the components of the device, including the outside arm, the middle portion, the inside arm, or a combination thereof. In some embodiments, vibrational sources are disposed only in the inside arm and the outside arm, and in other embodiments, vibrational sources are only disposed in the inside arm or in the outside arm. In preferred examples of the embodiment using only one motor, the vibrational source is disposed in the outside arm, to allow for direct vibrational stimulation of the clitoris or clitoral area. In this embodiment, the vibration can be communicated to the inside arm as the vibration from the vibrational source (for example, a vibrational motor) in the outside arm is transmitted along the skeleton.

In an alternative embodiment, the device includes at least two vibrational sources, in particular, at least two vibrational motors in the inside arm, for example, for stimulation of the g-spot and surrounding tissue inside the vagina. The at least two vibrational motors within the inside arm function together or independent of one another. In one example of independent motor control, one or more vibrational motors can be designated as "primary", in that it or they are activated first, and a second one or more vibrational motors can be designated as "secondary", in that it or they are activated second. In a specific example, the device comprises dual secondary motors for a total of three vibrational motors installed in the device.

Figure 12:
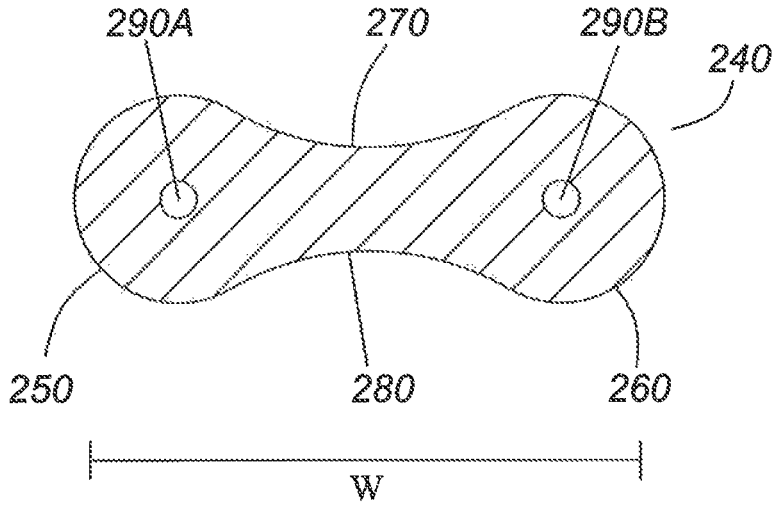
FIG. 12 is a cross-sectional view of an alternate example of the inside arm of a sexual stimulation device as described herein.

In one embodiment, as shown in FIG. 12, two or more vibrational sources are installed in the inside arm 40, separated from each other along the width (W) of the inside arm 40. For example, inside arm 240 can have a first edge 250 and second edge 260, generally spanning the width (W) of the inside arm 240. The inside arm 240 further includes an interior surface 270 and exterior surface 280, where the interior surface 270 is at least partially in contact with the anterior wall of the vagina upon insertion. There may be disposed in the inside arm 240 a plurality of vibrational sources 290. For example, there may be a first vibrational sources 290A and a second vibrational sources 290B, separated from each other along the width (W) of the inside arm 240. The use of multiple vibrational sources 290 may add to the vibrational force of the device during use, adding to the satisfaction of the user. In some embodiments, there may be a space of about 75% the width (W) separating the two vibrational sources (290A, 290B). In other embodiments, there may be a space of about 50%-75% of the width (W) of the inside arm 240 separating the vibrational sources (290A, 290B). The interior surface 270 and/or the exterior surface 280 may be substantially flat or they may have a concave or convex shape. In some embodiments, the interior surface 270 and/or the exterior surface 280 may have a wavy or bumpy shape. As seen in FIG. 12, one embodiment provides each surface 270, 280 with a concave shape, where the edges 250, 260 each have a greater thickness than at the middle of the inside arm 240. It may be desired that no vibrational sources 290 be disposed in the middle portion of the inside arm 240.

It may be desired that one or more vibrational motor is disposed in the inside arm, and another one or more motor is disposed in the outside arm. The locations of the motors can be varied within the inside arm, the outside arm and/or the middle portion.

Any desired vibrational source can be used in the present sexual stimulation device. In preferred embodiments, the vibrational source is a longitudinally oriented vibration motor provided with a small rotating eccentric weight or a piezo buzzer. Desirably, the motor is capable of reaching vibrational frequencies of between about 240 and about 10,000 RPM. In some embodiments, the motor(s) is capable of providing the device, or a component thereof, with motion, such as linear or circular motion, during use. Such movement can be controlled by a microprocessor and can perform varied patterns and rhythms, for example, in a range of from about 6 to about 600 Hz with an amplitude up to about 0.2". Springs, pistons, and/or other materials can be used to achieve the desired vibration and/or motion. The vibration can also be achieved using a vibrating cylindrical or disk shaped motor, that optionally includes electro-stimulation pad(s). Mechanical movement can be achieved through the use of drive shafts or push/pull rods housed in any component of the device.

The vibration source(s) can be protected in a protective shell. In one example, more than one longitudinally oriented vibration motor can be provided and, in such instances, wiring within the skeleton of the device can connect the first motor to a second motor, and then further wiring connects two motors to a power source comprising a battery such as an AA, or AAA NiCd. The motors can be connected to the power source in series or in parallel, or a combination thereof when there are more than two motors.

It will be understood, moreover, that the number, orientation, and strength of the vibrational source(s), will be a matter of choice to one skilled in the art.

The vibration source(s) and/or the power source can be included within the inner skeleton, as described above, or they can be contained within the housing of a separate body or cartridge that can be attached as a component of the outer arm of the sexual stimulation device. For example, see FIGS. 16B and 18B, where the cartridge is shown with reference numeral 450. The separate body or cartridge can optionally additionally comprise device control electronics. The separate body or cartridge can be permanently or removably attached as part of the outer arm. The removable attachment of such a component cartridge can permit variation of components included in the device. For example, a stronger or weaker vibration source or a different combination of vibrations sources can be incorporated in the present sexual stimulation device by simply changing the component cartridge. Similarly, a device can be supplied with one cartridge including a rechargeable power source and a second cartridge to permit use of the device with disposable batteries.

A switch, which is optionally a push button and central processing unit, or alternatively includes a three-position sliding switch, can be located near the outer end of the sexual stimulation device so that it can be manipulated between an "off" position and at least one "on" position before, during and/or after use. In some embodiments, the device can also be controlled by wireless means, such as radiofrequency, BLUETOOTH® or other wireless methods. In such instances, the sexual stimulation device can be provided with a remote control or, alternatively, it can be controlled using a secondary device (e.g., a mobile BLUETOOTH® enabled device). In a preferred embodiment, the device can be controlled by a switch located near the outer end of the sexual stimulation device and also by a switch that functions wirelessly in a remote control.

Furthermore, the switch can be provided with any number of "on" settings to power any combination of the motors at the same or different levels or direction of rotation or other movement. In addition to increasing or reducing the strength of the vibrations, this can create variable harmonic wave patterns in the device, so that a harmonic wave pattern pleasing to the user can be selected on an individual user basis. Moreover, the switch can be a push button, a dial, or any other suitable type of switch. Furthermore, the outer shell of the device itself can be made from a bimetallic alloy capable of "twitching" upon application of a current, which may be applied in any desired pattern.

In accordance with another embodiment, the sexual stimulation device is programmable. That is, the device can be programmed based on a particular user's preferences to provide, for example, a set vibration speed, combination of speeds, variation of vibration or pattern of vibration and/or movement. In certain examples, the device can be programmed to include multiple preset vibration settings/patterns.

The sexual stimulation device optionally includes or is provided with a recharging circuit and outlet. The recharging outlet can be accessible from the outside of the device, but it can be covered with a removable plug or sheath of non-toxic material in order to ensure that the device is water resistant or waterproof Alternately, the recharging circuit is an induction recharger that does not require metal-to-metal contact.

In one embodiment, the device comprises a recharging means, e.g., rechargeable battery that provides a trickle charge and/or quick charge.

In accordance with another embodiment, the sexual stimulation device is provided with a storage case or bag, which can be used for storage and/or travel.

It will also be understood that the present sexual stimulation device can be manufactured with a non-rechargeable battery, and so not be provided with a recharging circuit and outlet. If desired, the unit can be considered disposable after the battery is completely discharged. Alternatively, replaceable batteries can be used. In this case, the device is provided with a re-sealable access means, such as a peel-back silicone layer, to access the batteries, while providing protection and, optionally, water resistant during use.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A sexual stimulation device comprising:

(a) an inside arm configured to be placed within a vagina of a female;

(b) an outside arm configured to be placed against a clitoral area of said female; and (c) a middle portion connecting said inside arm and said outside arm;

wherein the device is dimensioned to be worn with the inside arm inserted into the vagina of said female during intercourse, and wherein said inside arm comprises an open center portion and opposed wing portions are outwardly curved from the open center portion.

2. The device of claim 1, wherein the open center portion is surrounded by the opposed wing portions and a connecting portion at an area of the inside arm farthest from the middle portion.

3. The device of claim 1, wherein the open center portion formed by the opposed wing portions middle portion and where a shape is open at an area of the inside arm farthest from the middle portion.

4. The device of claim 1, wherein the open center portion forms a generally rounded shape surrounded by the opposed wing portions and a connecting portion at the point of the inside arm farthest from the middle portion.

5. The device of claim 1, wherein the wing portions of the inside arm have a low profile.

6. The device of claim 1, wherein the inside arm comprises a transition portion that tapers down toward the middle portion of the device and that forms a reverse curve dimensioned for placement around a pelvic bone of the female when the inside arm is inserted in the vagina.

7. The device of claim 1, wherein the wing portions are resilient or malleable.

8. The device of claim 1, wherein said inside arm has a width of 10-80 mm, a thickness of 1-40 mm, or both.

9. The device of claim 1, wherein said inside arm has a ratio of width to thickness of 1.5:1 to 5:1.

10. The device of claim 1, wherein said middle portion is resilient, malleable, or both.

11. The device of claim 1, wherein said middle portion maintains said inside arm and said outside arm resiliently spaced apart in a relaxed position and/or wherein said middle portion resiliently urges said inside arm and said outside arm towards each other when flexed apart.

12. The device of claim 1, wherein said device can be deformed to different shapes.

13. The device of claim 1, wherein said middle portion has a thickness of 0.5-10 mm, a width of 5 mm to 40 mm, and a ratio of length to thickness of 10:1.

14. The device of claim 1, further comprising at least one vibrational source and wherein at least one of said at least one vibrational source is disposed within said inside arm.

15. The device of claim 1, wherein a portion of said inside arm, a portion of said outside arm is textured, or both.

16. The device of claim 1, wherein either the inner arm and the outer arm have an outer contour and wherein the outer contour of the outside arm corresponds the outer contour of the inner arm.

17. A sexual stimulation device comprising:

(a) an inside arm configured to be placed within a vagina of a female;

(b) an outside arm configured to be placed against a clitoral area of said female wherein the outside arm has a generally rounded shape; and (c) a middle portion connecting said inside arm and said outside arm;

wherein the device is dimensioned to be worn with the inside arm inserted into the vagina of said female during intercourse, and wherein said inside arm comprises an open center portion and opposed wing portions are outwardly curved from the open center portion.

18. The device of claim 17, wherein the inner arm and the outer arm have an outer contour, and wherein the outer contour of the outside arm corresponds the outer contour of the inner arm.

* * * * *